United States Patent [19]

Dingess

[11] Patent Number: 4,613,449

[45] Date of Patent: Sep. 23, 1986

[54] COMPOSITIONS FOR CLEANING ALUMINUM

[75] Inventor: John A. Dingess, Wheeling, Ill.

[73] Assignee: Safety-Kleen Corporation, Elgin, Ill.

[21] Appl. No.: 657,231

[22] Filed: Oct. 3, 1984

[51] Int. Cl.[4] ..... C11D 17/00; B08B 7/00

[52] U.S. Cl. ..... 252/174.17; 252/156; 252/133; 134/40

[58] Field of Search ..... 252/89.1, 133, 156, 252/174.17, 174.21; 134/40, 41, 3

[56] References Cited

U.S. PATENT DOCUMENTS 3,018,281 1/1962 Crecelius ..... 252/174.17
4,330,423 5/1982 Smolka et al. ..... 252/95

*Primary Examiner*—Paul Lieberman

*Assistant Examiner*—John F. McNally

*Attorney, Agent, or Firm*—James T. FitzGibbon; Angelo J. Bufalino

[57] ABSTRACT

Compositions and methods for cleaning the surface of aluminum articles encrusted with cooked-on grease, oil and protein residues. The method includes immersing aluminum cookware in a solution of about 50 to about 75 parts by weight of water, about 2 to about 5 parts by weight of a strong alkali metal hydroxide, from about ½ to about 2 parts by weight of calcium chloride, from about 2 to about 4 parts by weight of sucrose, from about 0.05 to about 0.2 parts by weight of a non-ionic surface active agent and from about 0.2 to about 0.5 parts of an anti-foaming agent. The articles may be soaked for 12 to 24 hours without damage.

10 Claims, No Drawings

COMPOSITIONS FOR CLEANING ALUMINUM

The present invention relates generally to chemical compositions, and more particularly, to specialty cleaning compositions which are useful in difficult applications, particularly those of cleaning cooking pots, pans and food service utensils.

It is well known that cooking utensils, such as pots, pans and flatware are soiled in use by a great variety of naturally occurring products which are difficult to remove. For example, during the time when a pot or kettle is used in kitchen service, it may, through ordinary use, oversight or neglect, accumulate numerous layers of baked-on, carbonized grease, protein material, and other decomposition products of food. In restaurant use, cooking pots and pans as are exposed to high temperatures for long periods of time, and are used to cook a large variety of products. These include meats, fats of various kinds, and fruits and vegetables. Such products, in turn contain not only proteinaceous material, but certain enzymes as well. Common foods also includes sugars, starches, and salts of various kinds.

When used continually, utensils are also exposed to spices and seasonings, various salts, and acids and bases. These include, for example, citric and other acids from fruits, various esters and alcohols, and certain relatively complex materials including dyes or dyelike compounds. Over a period of time, the residues of these compositions become hardened and baked on to the pans. The removal of such residues is very difficult because the compositions are no longer simply oils and greases which can be removed by conventional soaps.

In commercial food service, such as restaurant hotel, and catering operations, it is simply not practical to analyze the nature of each separate utensil stain or other residue, and consider the underlying substrate before attempting to clean it. Thus, various individual stains can be removed from most known kinds of cooking utensils by simple abrasive scrubbing, certain other materials may be removed by relatively long soaking, and still others may be treated by stronger, relatively rapidly acting chemicals. However, many compositions which are very effective against some stains are not considered safe for use with aluminum, a common constituent of food service utensils.

Other compositions are not desired for use with resin (commonly polymeric tetrafluoroethylene "TFE") coated products, while still others are considered damaging to stainless steel or copper. With the limited training facilities available for kitchen help, and with the need for speed and efficiency of cleaning, it is not uncommon for kitchen help not to differentiate among the materials from which various cooking utensils are made, and consequently either to fail to clean them effectively, or use cleaners which are adapted to clean one type of substrate but which are ineffective, or sometimes actually dangerous to others.

In particular, while there has always been and continues to be a strong need and demand for effective restaurant or other commercial cookware cleaners, there has heretofore been a lack of a suitable cleaning composition which is highly effective with both steel and aluminum, without being damaging to either.

Extended soaking is a very effective way of softening most cooking residues and dissolving them away, is not labor-intensive, and is simple. However, until the present, cleaners which are simple and safe for cooking have not been suitable for long term soaking of both aluminum and steel.

For many of those cleaners which were strong enough to soften deposits on steel actually attacked aluminum and dissolved it to the point where such cleaners could not be used. Other aluminum cleaners were generally not satisfactory for safe long-term soaking of aluminum, and were required to be watched and timed carefully to avoid damage. Alkali cleaners, because of their ability to saponify greases and oils, are highly desirable, but ordinarily attack aluminum in the absence of effective inhibitors. Inhibitors such as phenols, potassium salts of permanganates and chromates, are effective chemically but create problems of toxicity and color residue. Other compositions have further drawbacks, such as generating foam, or allowing redeposition of cleaned materials. Consequently, there is and has been a demand for corrosion inhibitor systems which are non-toxic, which are safe in an environment surrounding food preparation and serving, and which will clean steel and/or iron, but yet not damage aluminum utensils, even after considerable time.

According to the present invention, a cleaning system is provided which uses a relatively strong alkali, an inhibitor system comprised of a simple sugar, a calcium donor, a nonionic surfactant and an antifoaming agent. The prior art having failed to provide an effective, strong cleaner which will remove cooking residues and yet not affect aluminum adversely, even upon relatively long soaking, it is an object of the present invention to provide an improved cleaner which is safe in food service environments and which is noncorrosive to aluminum.

Another object of the invention is to provide an aluminum cleaner and corrosion inhibitor system which is adapted for us in a commercial kitchen environment.

Yet another object of the invention is to provide a commercial cleaning system for food service articles which is economical to produce and easy to use.

A further object of the invention is to provide a composition for cleaning cooking utensils which includes water, a strong base, together with an inhibiting system consisting of a simple sugar, a calcium salt, and the combination of a nonionic surface active agent and an anti-foaming additive.

A still further object of the invention is to provide an improved method of cleaning pots, pans and the like by immersing them totally over a long period in a solution containing materials adapted to attack stains and cooking residues on cookware without adversely affecting the aluminum from which the cookware is made.

Another object of the invention is to provide a highly effective aluminum cleaner and brightener which includes an inhibitor system which is effective to reduce destruction of the aluminum surface to an acceptable level.

The foregoing and other objects and advantages of the inventions are achieved and practiced by providing a cleaner which includes, by weight, about forty to one hundred parts of water, 2 to 5 parts by weight of a strong caustic, 0.5 to 2.0 parts of calcium salt, 2–3 parts sucrose or like sugar, with up to two percent of a surfactant and up to 0.5 parts of an antifoaming additive.

The manner in which the present invention achieves the foregoing and other objects will become more clearly apparent when reference is made to the following detailed description of the preferred embodiments of the invention set forth by way of particular example herein.

DESCRIPTION OF THE PREFERRED EMBODIMENTS OF THE INVENTION

It was desired to demonstrate the effectiveness of the chemical compositions embodying the present invention. Accordingly, a liquid preparation was made using the parts by weight of the materials set forth in the following example:

EXAMPLE 1

Cleaning composition:

| | Parts by weight |
|---|---|
| Water | 64.95 |
| KOH | 3.03 |
| $CaCl_2$ | 1.00 |
| Sucrose | 2.59 |
| Tergitol NPX | 0.072 |
| Antifoamer (nonionic) | 0.301 |

The potassium hydroxide was added to the water slowly with stirring. The additional materials were readily soluble in the solution; the nonionic "Tergitol NP-10" being a surfactant, was effectively dispersed in the solution. Tergitol NP-10 is a nonionic surfactant believed to comprise a Nonylphenol Polyethylene Glycol Ether and available from the Union Carbide Corporation of Old Ridgebury Rd., Danbury, Conn. 06817. The antifoamer was a nonionic antifoaming additive of a known type obtained from Trans-Chemco, Inc., Bristol, Wis. and believed to comprise an organic surface active agent.

In order to demonstrate the invention, aluminum "coupon" sections 5 centimeters square (area 25 cm) were cut from new (unused) restaurant hood and duct filters of the type shown and described in U.S. patent application Ser. No. 360,367 filed Mar. 22, 1982. These are combination filters, flame arrestors and grease collectors formed from contoured flat sheet aluminum stock. The specimens were 0.012 inches thick, mill finished aluminum of 1100 H14 specification. These specimens each presenting 50 $cm^2$ total surface area (considering both sides), were weighed and placed in the cleaning solution just described and permitted to reside for 24 hours. The coupons were then rinsed, dried and reweighed. The specimens, even after 24 hours of soaking, were found to have lost on the average only 13% of their original weight.

Calculations indicated that the rate of weight loss was 0.229 grams per square meter of exposed surface per hour. The specimens were shiny. There was no apparent evidence of the attack when immersed for up to several hours, and even after 24 hours, there was no visible evidence of pitting or corrosion.

EXAMPLE 2

A composition of the type described in Example 1 as prepared, but consisted only of the water and alkali, excluding the sucrose, calcium chloride, and antifoaming agent. Using the same aluminum specimens, the alkaline cleaner without the inhibitor completely dissolved all the aluminum in less than 24 hours.

EXAMPLE 3

A solution according to example 2 was made, to which were added the nonionic surfactant and the antifoaming agent, but with the inhibitor component being absent. Immersion of counterpart aluminum specimens resulted in their complete dissolution in less than 24 hours.

EXAMPLE 4

Next, the solution of Example 1 was used to clean commercial specimen aluminum pans. These pans had been used for months in commercial restaurant service. They were taken directly from a restaurant and not prepared for testing purposes per se. The pans were heavily encrusted with baked on carbon and were cut into "coupons" or specimens as described above and placed in the solution of Example 1 for 24 hours. When removed, their surface finish appeared smooth and clean after light brushing with a fiber brush, which easily loosened and removed accumulated carbon. The specimens were rinsed and displayed no evidence of pitting, but displayed a smooth, visibly clean aluminum surface free from obvious imperfections, stains or discoloration.

EXAMPLE 5

A solution similar to that described in Example 1 was prepared, and a steel cooking pan was taken from a commercial restaurant, which pan had been exposed to months of commercial continual service. These pans were heavily stained and encrusted with a carbonaceous, greasy residue. The pans were physically cut into specimens and placed in a control soaking solution as described in connection with Example 1 for 24 hours. Upon being removed, substantially all of the grease had been dissolved, but that which remained was easily scraped off with a soft brush. The surface of the steel appeared not to be pitted or corroded and its surface finish was clean and esthetically pleasing.

EXAMPLE 6

A specimen identical to that used in connection with Example 5 was prepared and soaked in a solution of 4% KOH, without additional additives. The cleaning ability was rated subjectively by comparison and description. The solution of Examples 1 and 5 appeared virtually as effective, from the standpoint of cleaning, as the 4% KOH solution alone.

In one or more repeated samplings, a slight reduction in cleaning ability with the lower, 3% concentration was noted in respect to the 4% concentration. Consequently, it was concluded that the solution possessed an ability to clean steel, with an ability substantially equal to that of a counterpart solution without the inhibitor

EXAMPLE 7

Following the foregoing tests, experiments were performed in four commercial restaurants. In each restaurant, a solution substantially identical to that described in connection with Examples 1 and 3 was used and the actual metal cookware was immersed in large cleaning tubs containing such solution for a period of eight to sixteen hours. At each of these locations, with several repetitions, the soaking type cleaner operated very satisfactorily as a cleaner. In no case was any aluminum cookware damaged; on the other hand, the aluminum cookware appeared to be bright and clean when taken from the solution, and yet not to suffer visible damage. While the specimens of actual cookware used were not weighed for purposes of practicality, calculations indicated the loss of less than ¼ gram per square meter per hour. This rate would not give rise to measurable wear over the life of the pan, that is, a pan of moderate size might typically have a 1/5 square meter surface area, and would therefore lose 0.05 grams per hour or less than 0.1 grams in two hours. Accordingly to the English system, this would aggregate approximately 0.003 ounces (one three hundreth of an ounce) in a pan perhaps weighing 1 to 4 pounds.

From the foregoing, it was concluded that a highly successful cleaner/inhibitor had been was developed for use in combination with a potassium hydroxide cleaning formula.

EXAMPLE 8

A cleaner solution was prepared such as that set forth in Example 1, except the KOH was present as 4 parts by weight rather than 3.03 parts by weight. This cleaner proved equal and in some respect superior to the cleaner of Example 1, that is, it provided excellent cleaning without sacrifice of appearance or adverse aluminum weight loss.

EXAMPLE 9

A composition was made as in Example 1 except that instead of one part of $CACl_2$, 3.4 parts of sucrose were provided. This composition operated satisfactorily; however, further experiments indicated that when the ratio of sucrose to calcium chloride decreased below about 2.5, the effectiveness of the inhibitor system was reduced. A range of 2.5 to about 3.4 was found to be most effective, with the sucrose being less effective in ratios of 4:1 or more with respect to the calcium chloride.

EXAMPLE 10

A composition was made as in Example 1, except that KOH was present at 4%, and 3.1% sucrose and 1% calcium chloride were provided. This composition was very effective and appeared very satisfactory in all respects.

From the foregoing, it was concluded that the preferred solutions range from about 2% to about 5% KOH, with about 1% calcium chloride being present and sucrose being present in a ratio of from about 2.2 to 2.5 up to 3.4 to 3.7 parts based on one part of calcium chloride. The calcium chloride can be varied from about ½% to about 3%, but is preferably used in a concentration of about 1% of the overall solution.

It is also possible to practice the invention by using the ratios of ingredients set forth in Example 1, but reducing the amount of water. This creates a somewhat faster acting solution and may be preferred in some instances.

The ingredients of the invention are susceptible to sale as two premixed solutions in water, one containing concentrated potassium hydroxide and the other containing the remainder of ingredients for addition to measured amounts of water. Preferably, $CaCl_2$ should be added to water, followed by the sucrose and finally the liquid ingredients forming the second solution mentioned above. These may be premeasured for dillution on the site, such comcept being advantageously used where cookware cleaning is provided as a service rather than as a sale of the cleaning solution per se. The provision of a concentrate lowers cost in relation to premixed products which are largely water.

The use of certain sugars, including sucrose, glucose, and fructose, as components of electrolytic sodium hydroxide solutions using aluminum as an anode has been reported, particularly in connection with substantial plating currents, and such sugars are recognized as assisting in corrosion reduction.* However, no teachings are known which relate to the combined use of sugars, caustics, soaps, or defoamers in grease and oil type cleaning environments.

*(N. Subramanyan and M. Krishnan, Br. Corros. J., 7(1982) p. 184. J. D. Talati and R. M. Modi, Transactions of the SAEST, 11.2 (1976) p. 259)

Thus, while the reasons for success of the invention are not known with certainty, it is believed possible that the corrosion inhibition achieved by the sugar-like materials in the presence of the soap formed by the reaction between the caustic material and the grease, together with the surfactants added to the solution provide a cleaning material which is in turn compatible with both the inhibitor and the non-ionic surfactant. The inhibitor may protect the aluminum while freeing the potassium for saponification of the grease in the presence of the less active calcium chloride, or example.

Referring to another aspect of the invention, the material is very favorable from the standpoint of not requiring vigilance in use. In the past, certain other cleaners tended to foam excessively, creating damage to the environment or indicating dissolution of aluminum. While a certain amount of foaming is desirable for removal and floating to the surface of impurities to prevent redeposition, a very slight foam only is found present in the preferred use of the invention. Consequently, contract workers or professional cleaners may advise kitchen workers merely to immerse the materials to be cleaned in a soaking tank with the confidence that no adverse reaction resulting in the generation of foam or the like will occur and create damage or inconvenience.

A major advantage of the present invention is thus its safety and ability to be used effectively by unskilled labor and not to require continual vigilance in use.

It will thus be seen that the present invention provides novel compositions and methods for removing soils and stains from cookware, including aluminum and iron and steel cookware in the presence of each other, such compositions and methods having a number of advantages and characteristics, including safety ease of use and other characteristics referred to in the foregoing specification.

Various examples of practicing the invention having been set forth by way of example, it is anticipated that variationsto the described examples will occur to those skilled in the art, and that variations to the described form of invention may be made without departing from the spirit of the invention or the scope of the appended claims.

I claim:

1. An aluminum cleaning composition comprising, in combination, from about 2 to about 5 parts by weight of a strong alkali metal hydroxide, from about ½ to about 2 parts by weight of calcium chloride, from about 2 to about 4 parts by weight of sucrose, from about 0.05 to about 0.2 parts by weight of a non-ionic surface active agent and from about 0.2 to about 0.5 parts of an organic anti-foaming agent, said composition being adapted, when diluted with from about 40 to about 75 parts by weight of water, to clean soiled aluminum surfaces without damage thereto during an immersion of up to 25 hours.

2. A cleaning composition as defined in claim 1 wherein said alkali metal hydroxide is potassium hydroxide.

3. A cleaning composition as defined in claim 1 wherein said alkali metal hydroxide is present in an amount of about 3 parts by weight.

4. A composition as defined in claim 1 wherein said surface active agent is a surface active agent which is the condensation product of an organic alkyl phenol and ethylene oxide.

5. A composition as defined in claim 1 wherein said alkali metal hydroxide comprises about 3 parts by weight, said calcium chloride about 1 part by weight, said sucrose about 2.6 parts by weight, and said surface active agent about 0.1 part by weight, with said anti-foaming agent being present in an amount of not more than 0.5 parts by weight.

6. A method of cleaning the surface of an aluminum article encrusted with cooked-on grease, oil and protein residues, said method, comprising immersing an article so encrusted in a solution comprising about 50 to about 75 parts by weight of water, from about 2 to about 5 parts by weight of a strong alkali metal hydroxide, from about ½ to about 2 parts by weight of calcium chloride, from about 2 to about 4 parts by weight of sucrose, from about 0.05 to about 0.2 parts by weight of a non-ionic surface active agent and from about 0.2 to about 0.5 parts of an organic anti-foaming agent, and thereafter removing said article from said solution and rinsing said article.

7. A method as defined in claim 6 wherein said alkali metal hydroxide is potassium hydroxide.

8. A method as defined in claim 6 wherein said alkali metal hydroxide is potassium hydroxide, and is present in an amount of about 4 parts by weight.

9. A method of inhibiting surface corrosion of an aluminum article being cleaned by immersion, said method comprising immersing an aluminum article in an aqueous solution having therein about 2 to 6% potassium hydroxide, about ½ to 4% calcium chloride, up to 1% non-ionic surfactant and up to 2% organic anti-foaming agent, said method including adding to said solution from about 2% to about 6% sucrose, based on the total weight of said composition.

10. A method of cleaning aluminum cookware, said method comprising the steps of simultaneously saponifying oil, grease, and protein residues by immersing said cookware in an aqueous solution having up to 6% by weight of a strong alkali metal hydroxide, emulsifying and dispersing said saponification products and said oils and greases not subject to saponification by provision in said solution of up to 1% of a non-ionic surfactant, inhibiting corrosion of said aluminum by providing up to 6% sucrose in said solution and providing up to about 3% of an antifoaming agent to reduce foaming in said cleaning composition, permitting said cookware to remain immersed for from about 1 to 24 hours, removing said article from said solution, and rinsing said article with water.

* * * * *